US005462221A

United States Patent [19]

Zink et al.

[11] Patent Number: 5,462,221

[45] Date of Patent: Oct. 31, 1995

[54] TOTE BOX HANDLE

[75] Inventors: Robert M. Zink; Donald J. Bazany, both of Grand Haven; Douglas E. Tramper, Jenison, all of Mich.

[73] Assignee: Bradford Company, Holland, Mich.

[21] Appl. No.: 368,559

[22] Filed: Jan. 4, 1995

[51] Int. Cl.[6] ..... B65D 5/468; B65D 5/42

[52] U.S. Cl. ..... 229/117.16; 229/117.26; 229/199

[58] Field of Search ..... 229/117.23, 117.24, 229/117.26, 198, 198.1, 199, 117.16

[56] References Cited

U.S. PATENT DOCUMENTS

| | | | |
|---|---|---|---|
| 2,191,291 | 2/1940 | Smith . | |
| 2,206,314 | 7/1940 | Werner . | |
| 2,359,335 | 10/1944 | Stuart et al. . | |
| 2,419,842 | 4/1947 | Lebold . | |
| 2,544,283 | 3/1951 | Snyder | 229/199 |
| 2,771,235 | 11/1956 | Stephenson . | |
| 2,801,786 | 8/1957 | Foster . | |
| 2,954,914 | 10/1960 | Herlitty | 229/199 |
| 3,279,676 | 10/1966 | Cornish . | |
| 3,659,774 | 5/1972 | Mielke | 229/199 |
| 4,359,183 | 11/1982 | Aida et al. . | |
| 4,524,902 | 6/1985 | Mortimer . | |
| 4,971,201 | 11/1990 | Sathre | 229/199 |
| 5,037,027 | 8/1991 | Nichols . | |
| 5,074,461 | 12/1991 | Parker et al. | 229/117.16 |
| 5,295,632 | 3/1994 | Zink et al. . | |

FOREIGN PATENT DOCUMENTS

| | | | |
|---|---|---|---|
| 2690135 | 10/1993 | France | 229/199 |

*Primary Examiner*—Gary E. Elkins
*Attorney, Agent, or Firm*—Wood, Herron & Evans

[57] ABSTRACT

An improved handle for use in a tote box is securely retained in a hole or cutout in a wall of the tote box without mechanical fasteners, The handle includes a flange which extends upwardly so that a portion thereof is captured within the channel sidewalls of a top rail on the top edge of the walls of the tote box, The handle of this invention can be used with either single or double ply tote box walls and is preferably molded from flexible plastic,

22 Claims, 3 Drawing Sheets

10

TOTE BOX HANDLE

BACKGROUND OF THE INVENTION

This invention relates to tote boxes and more particularly to a handle for use in single or double ply tote box walls.

Containers which are returnable/reusable are useful for the transportation, storage, and display of goods in commerce. Such containers, commonly called tote boxes, must be of sufficiently rigid construction to enable safe and damage free transport and storage of goods contained therein. These tote boxes are frequently designed so as to be stacked or mounted in a nesting relation for convenient transportation or storage of the tote boxes. In order to be stackable, the upper edge of the tote box is typically reinforced with a top rail or rim member which is adapted to receive another tote box stacked thereupon.

It is conventional to use a variety of materials for the construction of tote boxes such as corrugated paperboard, corrugated plastic sheet, sheet metal and other such materials. A tote box of the type described is disclosed in U.S. Pat. No. 5,295,632 which is assigned to the assignee of this invention.

For the convenient handling and lifting of the tote box, a handle or handhold is typically provided on the tote. One type of handhold comprises a cutout in a sidewall of the tote through which a user can insert his or her hand for lifting and/or carrying the tote and its contents. A molded plastic handle is commonly snap fit into the cutout to provide a more comfortable handhold for the user in that the tote box material at the cutout may have sharp or rough edges. In addition, the molded plastic handle provides a non-tearable handhold to prevent the ripping or tearing of the tote box material.

However, a problem has arisen with typical molded plastic handles which are snap fit into the tote box cutouts. The molded plastic handles are relatively flexible so that they can be inserted into the cutouts, but their flexibility also contributes to their tendency to become dislodged from the tote. The handles are advantageously made from molded plastic for ease and economy of manufacturing. Such handles frequently are pulled from the cutouts into which they are inserted. Typically the handles are pulled from the cutouts when the filled tote is being lifted or moved by someone grasping the handles.

One prior solution to this problem is to provide a two piece handle in which each piece is secured to the other by a mechanical fastener such as a rivet, screw or the like. The wall of the tote is sandwiched between portions of the two piece handle. However, the requirement of using screws or other mechanical fasteners to secure the handle adds to the cost and assembly time for the tote.

SUMMARY OF THE INVENTION

Accordingly, it is a primary objective of the present invention to provide a handle for a tote box which is securely retained without mechanical fasteners or the like in a cutout in a wall of the tote.

Another objective of this invention has been to provide such a tote box handle which can be easily and economically manufactured.

It is an additional objective of the present invention to provide such a tote box handle which can be used on either single or double ply tote box walls.

A further object of the present invention has been to reduce the amount of time and expense required to assemble a tote box with such handles.

The present invention is directed to a tote box which is assembled from a die cut box blank and top edge rail support. When folded into the appropriate shape, the die cut box blank results in a bottom, two side walls and two end walls. The top rail is attached over the top edge of the side and end walls. The tote box walls, either side or end walls, have cutouts or holes into which are inserted reinforcing hand holds to aid in manual handling of a loaded tote box.

To hold the erected box blank in an assembled relationship and to reinforce the top edge of the tote box, a channel shaped unitary top rail extends around the top edge of the tote box. This top rail has a downwardly open channel formed therein. When the downwardly open channel of the top rail is pushed down over the top edge of the erected box blank, the channel fits over a double thickness of the tote box formed from tabs or flaps extending from the side and end walls of the box blank. The top rail is locked onto the top edge of the box as the result of an inwardly extending hook on the bottom of the outermost channel wall which snaps beneath downwardly folded tabs on the top edge of the walls of the tote box. A tote box of the type described herein is disclosed in U.S. Pat. No. 5,295,632, which is hereby incorporated by reference.

The tote box handle according to this invention can be in either of two presently preferred embodiments. In a first embodiment, the handle is sandwiched between two layers or plies of the wall of the tote box. Each layer of the tote box wall has a hole or cutout in it to receive the handle. The handle has a flange which extends radially outwardly from a center portion of a grip of the handle so as to prevent the handle from being inadvertently pulled from the tote box wall. The flange includes an upper section which fits beneath the top rail of the tote so as to securely lock the handle in an assembled relation relative to the wall of the tote box.

A second presently preferred embodiment of the handle is intended to be used with a single ply wall of the container. This embodiment of the handle has two spaced flanges, one of which is located at the bottom on one side of the grip, and the other of which extends completely around the grip on the other side thereof. The flange which extends around the grip has an upper section which is sufficiently large that it fits into a channel of the top rail so as to lock the handle in an assembled relationship relative to the wall of the tote box.

The tote box and handle of this invention can be assembled rapidly without the need for intermediate fastener joining steps and without the need for screws, rivets or fasteners such as have been used to secure handles in prior art tote boxes. Furthermore, the tote box handle is securely retained in the cutout on the wall of the tote to avoid inadvertent removal or dislodgement of the handle.

BRIEF DESCRIPTION OF THE DRAWINGS

The objectives and features of the present invention will become more readily apparent when the following Detailed Description is taken in conjunction with the accompanying drawings in which.

DETAILED DESCRIPTION OF THE INVENTION

Figure 1:
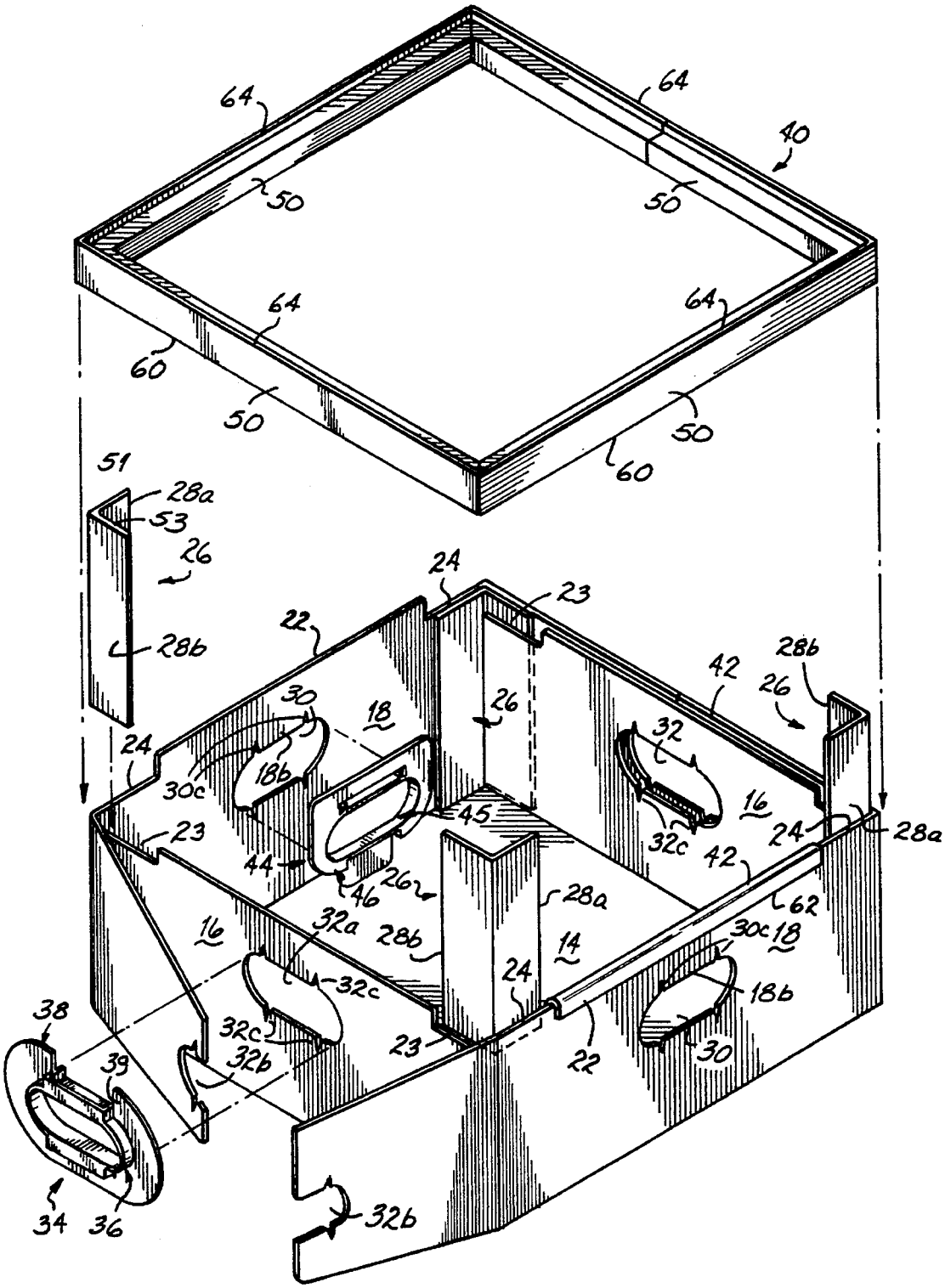
FIG. 1 is a partially exploded perspective view of a tote box with handles according to the present invention.
Figure 2:
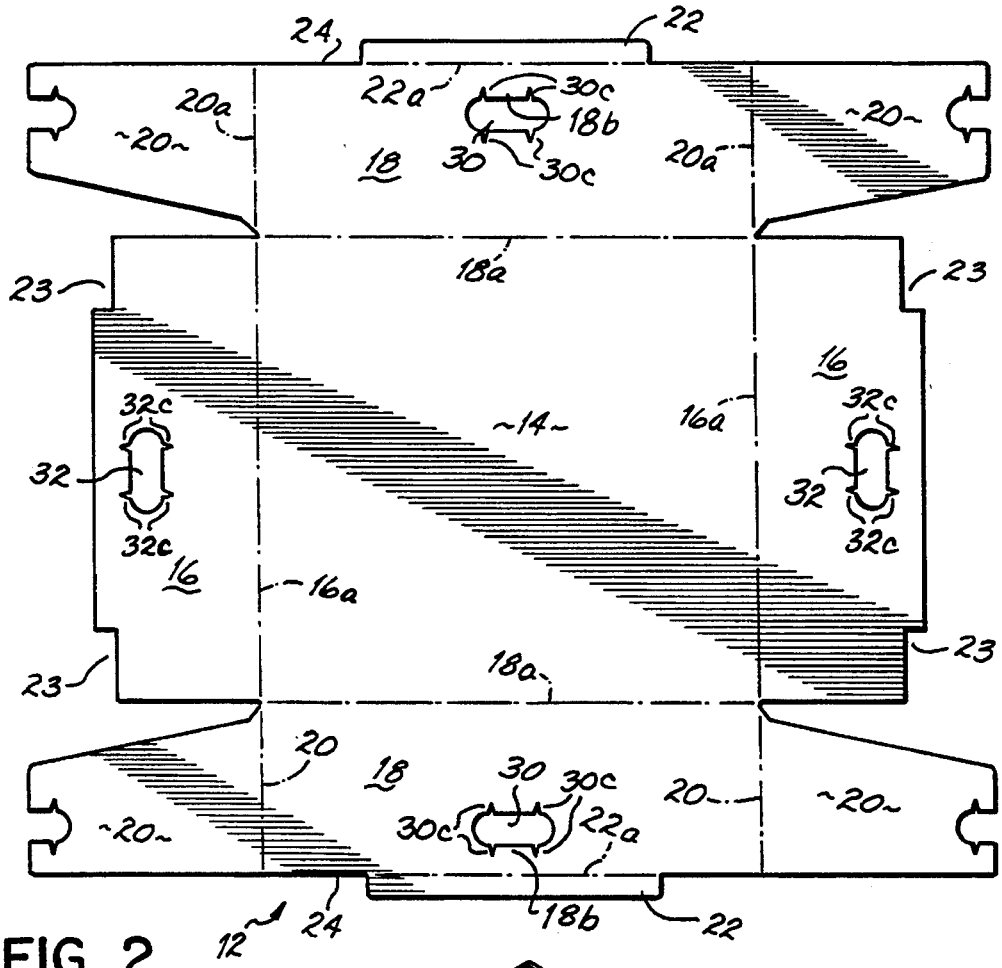
FIG. 2 is a top plan view of a box blank used to form the tote box of FIG. 1.

Referring to FIG. 1, a tote box 10 according to the present invention is shown. The tote box 10 is assembled from a uniform thickness box blank 12 (FIG. 2) which is die cut or otherwise precut from, preferably, corrugated plastic sheet. The box blank 12 has a bottom 14, two end walls 16 connected to the bottom 14 by fold lines 16*a*, two side walls 18 connected to the bottom 14 by fold lines 18*a*, and end flaps 20 which are lateral extensions of the side walls 18 and are connected thereto by fold lines 20*a*. Notches 23 are provided in the uppermost corners of each end wall 16 to facilitate the construction of the tote box 10 as described later in this disclosure. The box blank 12 also includes tabs 22 which are extensions on an uppermost edge 24 of the erected side wall 18 and are connected to the top edge of the side walls 18 by fold lines 22*a*. The tabs 22 are downwardly folded onto the side walls 18 as shown in FIG. 1.

Four corner enhancers 26 are used in a preferred embodiment of the tote box 10. These corner enhancers 26 are preferably made of plastic or aluminum. Each corner enhancer 26 has two equal length legs 28*a*, 28*b* which are substantially normal to one another and are of a height approximately equal to the height of the side and end walls 16, 18. The corner enhancers 26 add strength and structural rigidity to the tote box 10 and support the weight of other tote boxes stacked thereon.

Figure 3:
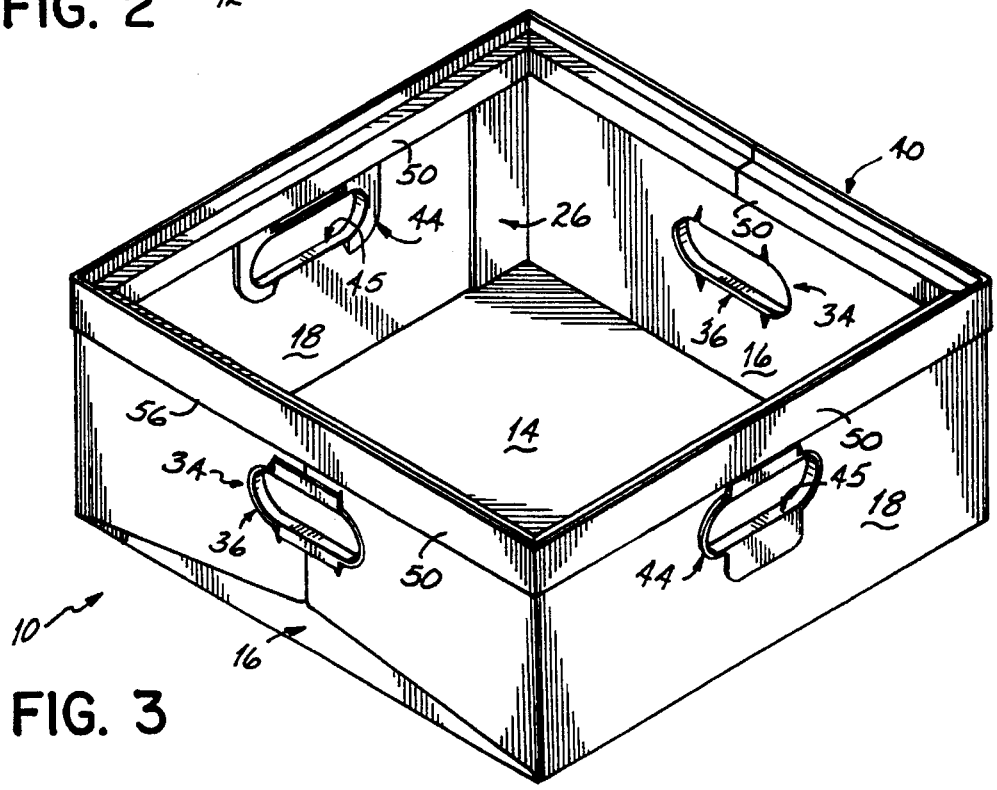
FIG. 3 is a perspective view of the assembled tote box of FIG. 1.

The side walls 18 and end walls 16 of the tote box 10 also include cutouts or oval holes centrally located on each wall as shown particularly in FIGS. 1 and 3. In a presently preferred embodiment of the tote box 10, the side walls 18 are single ply and therefore hole 30 extends through only a single thickness of the corrugated box blank 12. The end walls 16 are double ply; therefore, holes 32 in the end walls 16 include a hole 32*a* in the end wall 16 and a cutout 32*b* in each end flap 20 which is essentially one-half of an oval so that when the complementing end flaps 20 are folded against the end wall 16, a hole identical in size to the hole 32*a* in the end wall 16 is formed. The holes 30, 32 are each preferably provided with four triangular notches 30*c*, 32*c* extending therefrom with two of the notches being provided on the top side of each oval hole 30, 32 and two notches on the bottom side.

Figure 4:
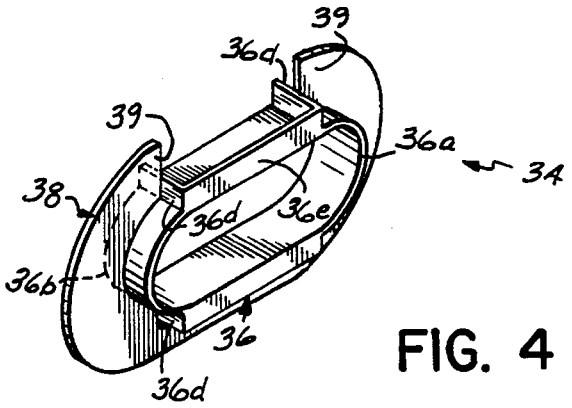
FIG. 4 is a perspective view of a first embodiment of the handle of this invention.
Figure 6:
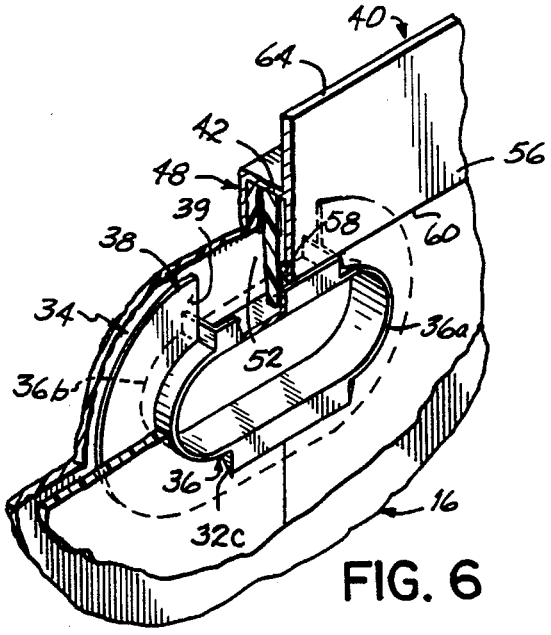
FIG. 6 is a perspective view of the handle of FIG. 4 assembled in a two ply wall of the tote box with the wall partially broken away.

The holes 32, 30 in the walls 16, 18 of the tote box 10 are adapted to receive therein a handle according to the present invention. The handle is securely held in the tote box 10 against inadvertent removal or dislodgement during the lifting or use of the tote box 10. A first embodiment 34 of the handle according to this invention is shown in FIG. 4 and is primarily intended for use in a double ply wall of the tote box 10 such as that shown in the end walls 16 of the tote box 10 in FIGS. 1 and 3. The first embodiment of the handle 34 as shown in FIG. 4 includes a generally oval grip 36 which projects perpendicularly with respect to a generally oval flange 38 extending around the entire perimeter of the grip 36. The outer periphery of the grip 36 is dimensioned for a snap-fit insertion into the oval hole 32*a* in the end wall 16 of the tote box 10. The flange 38 projects from the grip 36 and is centered thereon such that portions 36*a*, 36*b* of the grip 36 project perpendicularly with respect to the opposing faces of the flange 38 as can be seen in FIGS. 1 and 6. On the top and bottom sides of the grip 36, there are a pair of spaced transverse ribs 36*d* interconnected on the front or outside face of the grip by a longitudinally extending rib 36*e*. On the top side of the handle 34, the flange 38 has an opening or cutout between the transverse ribs 36*d*, 36*d*. This first embodiment of the handle 34 is intended to be used with a double ply wall of the tote box 10 so that the flange 38 is sandwiched between the end wall 16 and flaps 20 as shown in FIG. 6. Before the end flaps 20 are folded onto the end wall 16, the handle 34 is inserted into the hole 32*a* in the end wall 16 so that the portion 36*a* of the grip 36 projecting from the inside face of the flange is inserted into the hole 32*a* in the end wall 16 with the rib 36*d* being received in the triangular-shaped notches 32*c*. With the handle 34 inserted into the hole 32*a*, one face of the flange 38 is juxtaposed to the outer face of the end wall 16. The complementing end flaps 20 are then folded onto the end wall 16 so that the cutouts 32*b* in the end flaps 20 form around the perimeter of the portion 36*b* of the grip 36. The portion 36*a* of the grip 36 projecting outwardly from the second face of the flange 38 is seated within the cutouts 32*b* in the end flaps 20 as shown in FIG. 3, and a small portion of the end flaps 20 snap over and the inside of the longitudinally extending rib 36*e*, thereby to hold the flaps 20 in an assembled relationship relative to the end wall 16 until the flaps and end walls are subsequently welded or otherwise fixedly secured together. An inner face of the end flaps 20 is juxtaposed to the outer face of the flange 38 when the handle 34 is positioned as described and shown in FIG. 6.

An upper portion 39 of the flange 38 projects upwardly from the hole 32 toward the top edge 42 of the box 10 so that when a top rail 40 is pressed down onto the top edge 42 of the erected tote box 10, a downwardly open channel 48 formed between channel side walls 50 of a top rail 40 captures the upper portion 39 of the flange 38 along with the top edge 42 and tabs 22 on the end wall 16 as shown in FIG. 6. As a result, the handle 34 is securely retained in the hole 32 of the tote box 10 and is prevented from inadvertently being removed or dislodged from the tote box 10 during use.

Figure 5:
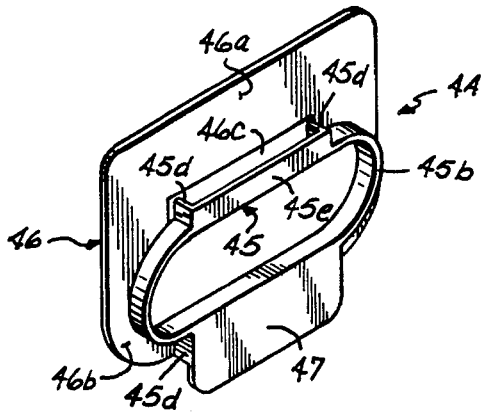
FIG. 5 is a perspective view of a second embodiment of the handle of this invention.
Figure 7:
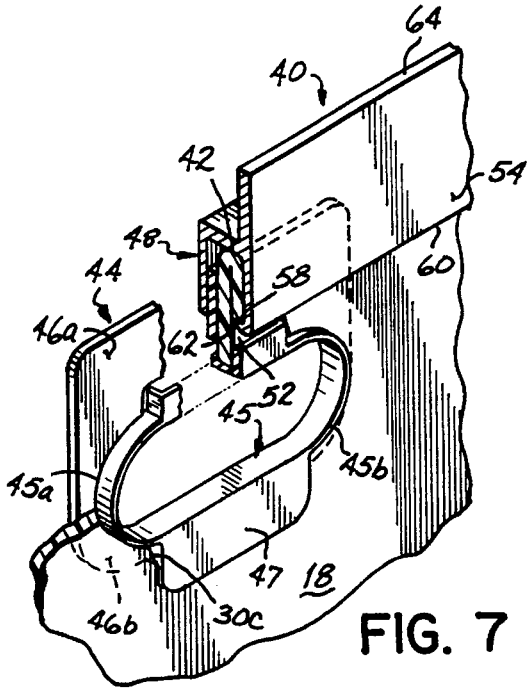
FIG. 7 is a perspective view of the handle of FIG. 5 assembled in a single ply wall of the tote box with the wall partially broken away.

A second embodiment 44 of the handle according to this invention is shown in FIGS. 5 and 7 and is intended for use on a single ply wall such the side wall 18 shown in FIGS. 1 and 3. The second embodiment of the handle 44 includes an oval shaped grip 45 with a first flange 46 extending from an inner edge 45*a* of the grip 45 perpendicularly with respect thereto. The first flange 46 projects around both sides and the top of the grip 45 and has an upper portion 46*a* which is larger than side portions 46*b* thereof as shown in FIG. 5. The second embodiment of the handle 44 also includes a second flange 47 which projects downwardly from an outer edge 45*b* of the grip 45. As shown in the drawings, the first and second flanges 46, 47 are generally rectangular, but it will be appreciated by one of ordinary skill in the art that other configurations are possible within the scope of this invention.

As in the case of the first embodiment of the handle 34, the handle 44 has on the top and bottom sides of the grip 45 a pair of spaced transverse ribs 45*d*. The bottom pair of transverse ribs 45*d* are interconnected on the outside edge of grip 45 by the flange 47 and the topmost pair of ribs 45*d* are interconnected by a longitudinally extending rib 45*e*, which rib 45*e* also extends outwardly from the outer edge of the grip 45 so that the flange 47 and the longitudinally extending rib 45*e* are located in the same vertical plane. A cutout or hole 46*c* in the inside flange 46 surrounds the transverse ribs 45*d* and the longitudinal rib 45*e*.

Prior to securing the top rail 40 to the tote box 10, the second embodiment of the handle 44 is snap-fit into the hole 30 in the side wall 18 of the tote 10 so that a first face of the first flange 46 is juxtaposed to an inner face of the side wall 18 and the outer perimeter of the grip 45 is snugly received within the hole 30. The second flange 47 is juxtaposed to an outer surface of the side wall 18 when the handle 44 is inserted into the hole 30. When thus snap fit into the hole 30 of the side wall 18, a downwardly extending portion 18*b* of the side wall 18 between two triangular notches 30*c* extends downwardly and is entrapped between the longitudinal rib 45*e* on the front or outside of the wall 18 and the flange 46*c* on the rear side of the wall 18.

The upper portion 46*a* of the first flange 46 extends upwardly from the hole 30 and is captured between the channel side walls 50 of the top rail 40 as shown in FIG. 7. It will be appreciated by one of ordinary skill in the art that the width of the channel 48 formed between the channel side walls 50 of the top rail 40 should be sufficiently sized to accept the flange 46 or 38 from either embodiment of the handle 34 or 44 along with the single or double ply of the wall 16 or 18 of the tote box 10 and the tab 22 folded thereon.

To assemble the tote box 10, the side walls 18 are first folded upward. The handles 44 can then be inserted into the hole 30 in the side wall 18 as described hereinabove. Next, the end walls 16 are folded upward, the end flaps 20 are then folded inwardly, and the handles 34 inserted into the holes 32 in the end walls 16 as described hereinabove.

Once the side walls 18 and the end walls 16 are erected and the handles 34, 44 inserted as previously described, the corner enhancers 26 are inserted into each corner of the erected tote box 10 such that an outside surface 51 of the first corner enhancer leg 28*a* is parallel to the side wall 18 and adjacent to the inside surface of that side wall 18. An inside surface 53 the second corner enhancer leg 28*b* is parallel to the erected end wall 16 and is adjacent to the outside surface of that end wall 16. The corner enhancer 26 is thereby sandwiched with the second corner enhancer leg 28*b* between the end wall 16 and the end flap 20.

The top rail 40 is then snapped onto a top edge 42 of the erected box 10. The top edge 42 is formed from a top edge of each end wall 16 and each side wall 18. Prior to securing the top rail 40, the tabs 22 must be folded downward upon the side walls 18. Once the tabs 22 are folded, the unitary top rail 40 can be snapped onto the top edge 42 of the erected tote box 10. The top rail 40 has a downwardly open channel 48 which is formed by two spaced channel side walls 50 as shown in FIG. 4. The channel 48 has an opening 52 of a width sufficient to grip the multi-ply top edge of the box 10 and the upper portion 39 or 46*a* of the flange 38 or 46. The channel opening 52 is of sufficient width to accommodate the upper portion 46*a* of the flange 46, the side wall 18 and tab 22 folded thereon in a first section 54 of the top rail 40, and the end wall 16, upper portion 39 of the flange 38 and end flap 20 folded thereon in a second section 56 of the top rail, all as shown in FIGS. 6 and 7. The notches 23 permit the channel opening 52 to conveniently fit over the end flap 20 and the corner enhancer leg 28*b* in this region of the erected tote box 10 without the interference of the end wall 16.

An inwardly extending hook 58 is provided on a bottom edge 60 of each channel wall 50 in the preferred embodiment. When the top rail 40 is snapped onto the erected tote box 10, one of the hooks 58 engages a bottom edge 62 of the downwardly folded side tab 22 thereby securing the top rail 40 on the erected tote box 10 as shown in FIG. 7. Once the top rail 40 is pressed onto the top edge 42 of the tote box 10 and one of the hooks 58 engages the downwardly folded tabs 22, the tote box 10 of this preferred embodiment is erected without the benefit of mechanical fasteners, rivets, staples, or the like. While the tab 22 is illustrated in FIG. 1 as being folded downwardly on the outside of the side wall 18, it could just as well be folded downwardly on the inside of this same wall.

The top rail 40 according to a preferred embodiment of the present invention has a vertically extending lip 64 on an outside upper edge thereof. The lip 64 facilitates the stacking of a second tote box in a nested relationship upon a tote box 10 of the present invention. The weight of the tote box stacked on the top rail 40 is distributed around the top rail 40 and supported by the corner enhancers 26 of this embodiment of the present invention. It will be appreciated that other configurations and embodiments of tote boxes and handles can be used within the scope of the appended claims.

From the above disclosure of the general principles of the present invention and the preceding detailed description of the preferred embodiments, those skilled in the art will readily comprehend the various modifications to which the present invention is susceptible. Therefore, we desire to be limited only by the scope of the following claims and equivalents thereof.

We claim:

1. A tote box comprising:

a box formed from a foldable box blank and having a bottom and upstanding walls, and said walls having upper edges which form a top edge of said box;

a unitary top rail extending around the top edge of said box, said top rail having a downwardly open channel formed between a pair of channel side walls, said channel being fitted over said top edge of said box;

a hole in selected ones of said walls; and a handle inserted into said hole, said handle having a flange extending from said hole when said handle is inserted therein, a portion of said flange being captured between said channel sidewalls of said top rail in order to secure said handle to said erected box.

2. The tote box of claim 1 wherein said handle further comprises a grip which projects generally perpendicularly from said flange, said grip being snap fit into said hole.

3. The tote box of claim 1 wherein said selected ones of said walls have a first and a second ply, said flange being sandwiched between said first and second plies.

4. The tote box of claim 1 further comprising:

a second flange on said handle, said second flange being spaced from said flange, said flange being juxtaposed to a first face of said selected ones of said walls and said second flange being juxtaposed to a second face of said selected ones of said walls.

5. The tote box of claim 4 wherein said selected ones of said walls are single ply.

6. The tote box of claim 4 wherein said flange extends upwardly and around the sides of said handle and said hole into which it is inserted and said second flange projects downwardly from said hole.

7. The tote box of claim 1 wherein said flange extends substantially completely around said handle and said hole into which it is inserted.

8. The tote box of claim 1 further comprising:

a plurality of corner enhancers, one of which resides in each inside corner of said box.

9. The tote box of claim 1 further comprising:

an inwardly extending hook on a bottom edge of at least one of said channel side walls of said top rail for engaging said box walls and locking said top rail onto said top edge.

10. The tote box of claim 1 wherein said foldable box blank is made of corrugated plastic sheet.

11. The tote box of claim 1 wherein said top rail has a vertical lip on an outside upper edge thereof for facilitating the stacking of a second tote box on top of said tote box.

12. The tote box of claim 1 wherein said handle is molded plastic.

13. A tote box comprising:

a box formed from a foldable box blank and having a bottom and upstanding walls, said walls having upper edges which form a top edge of said box;

a unitary top rail extending around the top edge of said box, said top rail having a downwardly open channel formed between a pair of channel side walls, said channel being fitted over said top edge of said box;

a hole in selected ones of said walls; and a handle inserted into said hole, said handle having a flange extending from and substantially completely around said hole when said handle is inserted therein, a portion of said flange being captured between said channel sidewalls of said top rail in order to secure said handle to said erected box, said handle further comprising a grip which projects generally perpendicularly from said flange, said grip being snap fit into said hole.

14. The tote box of claim 13 further comprising:

a second flange on said handle, said second flange being spaced from said flange, said flange being juxtaposed to a first face of said selected ones of said walls and said second flange being juxtaposed to a second face of said selected ones of said walls.

15. The tote box of claim 14 wherein said selected ones of said walls are single ply.

16. The tote box of claim 14 wherein said flange extends upwardly and around the sides of said handle and said hole into which it is inserted and said second flange projects downwardly from said hole.

17. The tote box of claim 13 wherein said handle is molded plastic.

18. A handle for a tote box having at least one upstanding wall with a top rail extending around a top edge of said at least one wall, said top rail having a downwardly open channel formed between a pair of channel side walls, said channel being fitted over said top edge of said at least one wall, said at least one wall having a hole therein to receive said handle, said handle comprising:

a flange extending from the hole when the handle is inserted therein, a portion of said flange being captured between the channel sidewalls of the top rail in order to secure the handle to the tote box; and a grip adapted to be grasped by a user lifting the tote box, said grip projecting generally perpendicularly from said flange and being snap fit into the hole.

19. The handle of claim 18 further comprising:

a second flange spaced from said flange, said flange being juxtaposed to a first face of the at least one wall and said second flange being juxtaposed to a second face of the at least one wall.

20. The handle of claim 18 wherein said second flange projects downwardly from said grip.

21. The handle of claim 18 wherein the at least one wall has two plies and said flange is sandwiched between the two plies, 22. The handle of claim 18 wherein said flange and said grip are molded from plastic as one piece.

* * * * *